US008157459B2

(12) United States Patent
Hatada et al.

(10) Patent No.: US 8,157,459 B2
(45) Date of Patent: Apr. 17, 2012

(54) RECORDING APPARATUS AND METHOD FOR CONTROLLING THE ROTATION OF ROTATING SECTION IN RECORDING APPARATUS

(75) Inventors: Kenji Hatada, Shiojiri (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 12/454,692

(22) Filed: May 21, 2009

(65) Prior Publication Data

US 2009/0297244 A1 Dec. 3, 2009

(30) Foreign Application Priority Data

May 23, 2008 (JP) ..... 2008-135157

(51) Int. Cl.
*B41J 11/00* (2006.01)

(52) U.S. Cl. ..... 400/582

(58) Field of Classification Search ..... 400/582, 400/583.1–583.4; 101/225, 232, 248; 347/215
See application file for complete search history.

(56) References Cited

U.S. PATENT DOCUMENTS 4,428,288 A * 1/1984 Harper et al. ..... 101/248
6,070,044 A * 5/2000 Hoffmann et al. ..... 399/325
6,833,014 B2 * 12/2004 Welygan et al. ..... 51/293
6,991,391 B2 * 1/2006 Maruyama ..... 400/613

FOREIGN PATENT DOCUMENTS

JP 2007-245544 9/2007

* cited by examiner

*Primary Examiner* — Seung Lee
(74) *Attorney, Agent, or Firm* — Nutter McClennen & Fish LLP; John J. Penny, V.

(57) ABSTRACT

A recording apparatus performs recording on a strip of a recording target medium that is fed from a roll object that is set in or on the recording apparatus. The roll object is formed as, or at least includes, a roll of the recording target medium. The recording apparatus includes: a rotating unit that rotates the roll object; a rotation controlling unit that controls the rotation of the rotating unit; and a roll object diameter measuring unit that measures the diameter of the roll object, wherein the rotation controlling unit sets the rotation speed of the rotating unit or the rotation amount of the rotating unit on the basis of the diameter of the roll object measured by the roll object diameter measuring unit so as to ensure that at least either one of the transportation speed of the recording target medium and the transportation distance of the recording target medium is set at a predetermined value.

8 Claims, 9 Drawing Sheets

FIG. 10

<TABLE T1>

| DIAMETER D OF PAPER ROLL 3 | ROTATION SPEED F OF PAPER ROLL MOTOR 13 |
|---|---|
| d1≤ D < d2 | F1 |
| d2≤ D < d3 | F2 |
| d3≤ D < d4 | F3 |
| d4≤ D < d5 | F4 |
| d5≤ D < d6 | F5 |
| d6≤ D < d7 | F6 |
| d7≤ D < d8 | F7 |
| d8≤ D < d9 | F8 |
| d9≤ D < d10 | F9 |
| d10≤ D < d11 | F10 |
| d11≤ D < d12 | F11 |
| d12≤ D < d13 | F12 |
| d13≤ D < d14 | F13 |
| d14≤ D < d15 | F14 |
| d15≤ D < d16 | F15 |

FIG. 11

<TABLE T2>

| ROTATION AMOUNT OF PAPER ROLL MOTOR 13 | TRANSPORTATION SPEED ACHIEVED BY PAPER ROLL 3 HAVING DIAMETER Ds | ROTATION SPEED F OF PAPER ROLL MOTOR 13 |
|---|---|---|
| P1 | V1 | C1 |
| P2 | V2 | C2 |
| P3 | V3 | C3 |
| P4 | V4 | C4 |
| • • • | • • • | • • • |
| • • • | • • • | • • • |
| • • • | • • • | • • • |
| • • • | • • • | • • • |
| Pn | Vn | Cn |

<TABLE T3>

| DIAMETER D OF PAPER ROLL 3 | ROTATION AMOUNT L OF PAPER ROLL MOTOR 13 |
|---|---|
| d1 ≤ D < d2 | L1 |
| d2 ≤ D < d3 | L2 |
| d3 ≤ D < d4 | L3 |
| d4 ≤ D < d5 | L4 |
| d5 ≤ D < d6 | L5 |
| d6 ≤ D < d7 | L6 |
| d7 ≤ D < d8 | L7 |
| d8 ≤ D < d9 | L8 |
| d9 ≤ D < d10 | L9 |
| d10 ≤ D < d11 | L10 |
| d11 ≤ D < d12 | L11 |
| d12 ≤ D < d13 | L12 |
| d13 ≤ D < d14 | L13 |
| d14 ≤ D < d15 | L14 |
| d15 ≤ D < d16 | L15 |

RECORDING APPARATUS AND METHOD FOR CONTROLLING THE ROTATION OF ROTATING SECTION IN RECORDING APPARATUS

Priority is claimed under 35 U.S.C. §119 to Japanese Application No. 2008-135157 filed on May 23, 2008, which is hereby incorporated by reference in its entirety.

BACKGROUND

1. Technical Field

The present invention relates to a recording apparatus, and further relates to a method for controlling the rotation of a rotating section in a recording apparatus.

2. Related Art

Some recording apparatuses of the related art perform recording operation on recording paper that is drawn from a paper roll. The recording apparatus is provided with a paper roll housing unit in which the paper roll is set. The paper roll is formed as a roll of elongated ribbon-like, tape-like, or belt-like recording paper. A paper transport roller draws a strip of recording paper from the paper roll that is set inside the paper roll housing unit. The recording paper is drawn toward a recording head. Then, the recording apparatus performs recording, for example, prints an image and the like, on the recording paper that has been unrolled out of the paper roll with the use of the recording head. If a recording target part of the recording paper at which an image or the like is to be printed with the use of the recording head is not tensioned sufficiently in the recording operation of such a recording apparatus of the related art, it is difficult to keep a regular gap between the recording head and the recording paper thereat. Because of the irregular gap at the recording target part thereof that lacks sufficient tension, the recording head might fail to print an image at a desired target position. For this reason, the quality of an image formed as a result of such recording operation could be poor. Or, because of insufficient tension thereat, there is a risk that a paper jam transportation failure occurs.

An example of a recording apparatus that is designed to address the problems explained above is described in JP-A-2007-245544. The recording apparatus that is described in JP-A-2007-245544 is provided with a torque limiter that generates a predetermined torque that acts in a direction opposite to the drawing direction on a paper roll on the basis of the diameter of the paper roll, that is, on the basis of the remaining amount of recording paper. The rotation of a paper transport roller is controlled depending on the generated torque. As a result, the recording paper that is drawn by the paper transport roller is tensioned adequately and thus has not any slack.

However, if such a configuration in which a rotating section applies a rotation force to the paper roll is adopted, it is necessary to control the rotation amount of the rotating section or the rotation speed thereof depending on the diameter of the paper roll. For example, in a case where a configuration in which a rotating section such as a rotation motor or the like rotates the paper roll in the direction opposite to the drawing direction so as to tension the recording medium is adopted, or in a case where a configuration in which the rotation speed of the paper roll is controlled with the use of a driving section so as to generate a back tension is adopted, it is necessary to control the rotation amount of the rotating section or the rotation speed thereof depending on the diameter of the paper roll.

SUMMARY

An advantage of some aspects of at least one embodiment of the invention is to provide a recording apparatus that is capable of controlling the rotation amount of a rotating section or the rotation speed thereof depending on the diameter of a roll object (e.g., paper roll) when a rotation force is applied to the roll object by the rotating section. In addition, at least one embodiment of the invention provides, as an advantage of some aspects thereof, a method for controlling the rotation of a rotating section in such a recording apparatus.

In order to address the above-identified problems without any limitation thereto, at least one embodiment of the invention provides, as a first aspect thereof, a recording apparatus that performs recording on a strip of a recording target medium that is fed from a roll object that is set in or on the recording apparatus. The roll object is formed as, or at least includes, a roll of the recording target medium. The recording apparatus according to the first aspect includes: a rotating section that rotates the roll object; a rotation controlling section that controls the rotation of the rotating section; and a roll object diameter measuring section that measures the diameter of the roll object, wherein the rotation controlling section sets the rotation speed of the rotating section or the rotation amount of the rotating section on the basis of the diameter of the roll object measured by the roll object diameter measuring section so as to ensure that at least either one of the transportation speed of the recording target medium and the transportation distance of the recording target medium is set at (i.e., into) a predetermined value.

Since a recording apparatus according to the first aspect of at least one embodiment of the invention has the configuration described above, it is possible to ensure that at least either one of the transportation speed of the recording target medium and the transportation distance of the recording target medium is set at a predetermined value regardless of the diameter of the roll object.

In the configuration of a recording apparatus according to the first aspect of at least one embodiment of the invention described above, it is preferable that a table in which the diameter of the roll object and either the rotation speed of the rotating section or the rotation amount of the rotating section are set in association with or in correspondence to each other so as to ensure that at least either one of the transportation speed of the recording target medium and the transportation distance of the recording target medium is set at the predetermined value should be pre-stored; and the rotation controlling section should set the rotation speed of the rotating section or the rotation amount of the rotating section on the basis of relation set in the table.

With the preferred configuration of a recording apparatus described above, it is possible to easily set at least either one of the transportation speed of the recording target medium and the transportation distance of the recording target medium at a predetermined value.

It is preferable that a recording apparatus according to the first aspect of at least one embodiment of the invention described above should further include a multiplying factor computing section that calculates a multiplying factor as the ratio of a predetermined diameter of the roll object to a measurement diameter of the roll object that has been measured by the roll object diameter measuring section, wherein a table in which the rotation speed of the rotating section that is required for setting the transportation speed of the recording target medium corresponding to the roll object that has the predetermined diameter into a predetermined value is set is pre-stored; and the rotation controlling section sets the rotation speed of the rotating section at a value that is equal to the rotation speed set in the table multiplied by the multiplying factor calculated by the multiplying factor computing section.

With the preferred configuration of a recording apparatus described above, it is possible to easily control the transportation speed of the recording target medium.

In the configuration of a recording apparatus according to the first aspect of at least one embodiment of the invention described above, it is preferable that the roll object diameter measuring section should include a roll object rotation amount detecting section that detects the amount of the rotation of the roll object, a transportation amount detecting section that detects the amount of the transportation of the recording target medium, and a computing section that computes the diameter of the roll object on the basis of the rotation amount of the roll object detected by the roll object rotation amount detecting section and the transportation amount of the recording target medium detected by the transportation amount detecting section.

With the preferred configuration of a recording apparatus described above, it is possible to easily measure the diameter of the roll object.

In order to address the above-identified problems without any limitation thereto, at least one embodiment of the invention provides, as a second aspect thereof, a method for controlling the rotation of a rotating section in a recording apparatus that performs recording on a strip of a recording target medium that is fed from a roll object that is rotated by the rotating section, which is a constituent element of the recording apparatus. The roll object is formed as, or at least includes, a roll of the recording target medium. The rotation controlling method according to the second aspect of the invention includes: measuring the diameter of the roll object; and setting the rotation speed of the rotating section or the rotation amount of the rotating section on the basis of the measured diameter of the roll object so as to ensure that at least either one of the transportation speed of the recording target medium and the transportation distance of the recording target medium is set at a predetermined value.

Since a method for controlling the rotation of a rotating section in a recording apparatus according to the second aspect of the invention has features described above, it is possible to ensure that at least either one of the transportation speed of the recording target medium and the transportation distance of the recording target medium is set at a predetermined value regardless of the diameter of the roll object.

BRIEF DESCRIPTION OF THE DRAWINGS

The invention will be described with reference to the accompanying drawings, wherein like numbers reference like elements.

FIG. 10 is a table that shows an example of the relationship between the diameter of the paper roll and the rotation speed of the paper roll motor according to an exemplary embodiment of the invention.

FIG. 11 is a table that shows an example of the relation between a predetermined transportation speed achieved by the paper roll that has a predetermined diameter and the rotation speed of the paper roll motor corresponding to the predetermined transportation speed according to an exemplary embodiment of the invention.

DESCRIPTION OF EXEMPLARY EMBODIMENTS

With reference to the accompanying drawings, exemplary embodiments of the present invention will now be explained in detail. A method for controlling the rotation of a rotating section in a recording apparatus will be explained below together with the operation of a printer 1.

Overall Configuration of Printer

Figure 1:
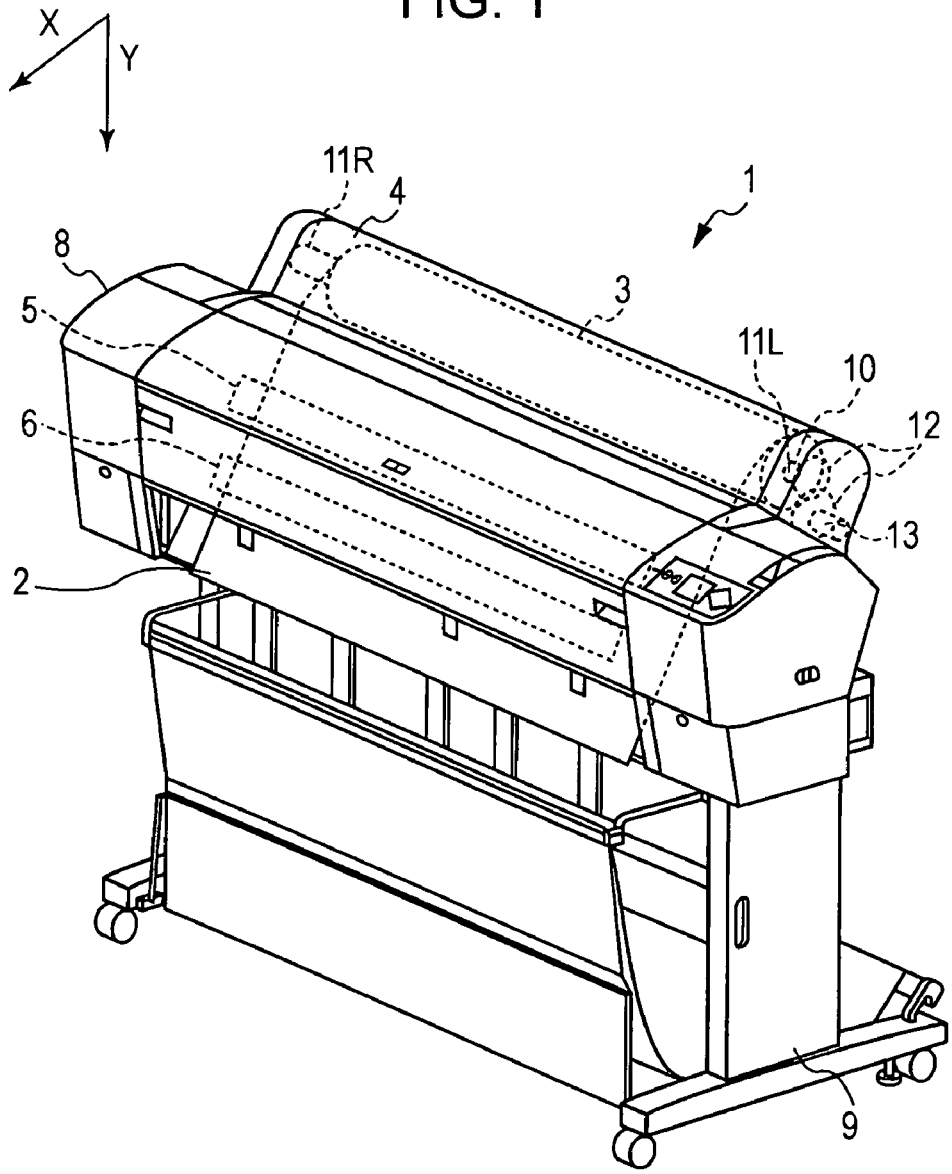
FIG. 1 is a perspective view that schematically illustrates an example of the general appearance of a printer according to an exemplary embodiment of the invention.
Figure 2:
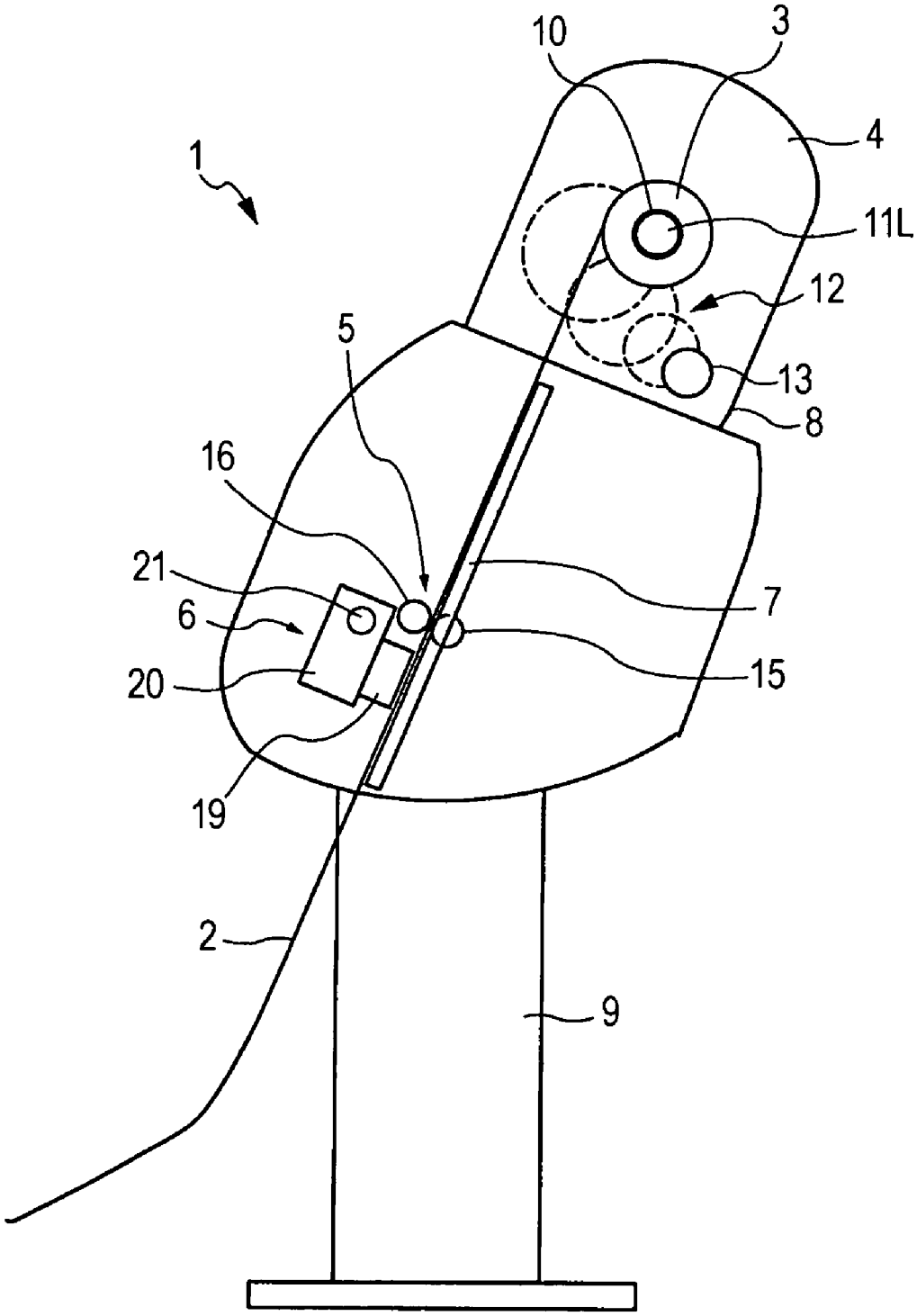
FIG. 2 is a side component diagram that schematically illustrates, in a side view, an example of some inner components of the printer according to an exemplary embodiment of the invention.

FIG. 1 is a perspective view that schematically illustrates an example of the general appearance of the printer 1 according to an exemplary embodiment of the invention. The printer 1 described herein is a non-limiting example of a recording apparatus according to an aspect of the at least one embodiment of invention. In FIG. 1, a frontward direction, that is, a direction from the rear of the printer 1 toward the front thereof, is indicated with an arrow X. The direction opposite to the arrowed direction X is defined as a rearward direction, that is, a direction from the front of the printer 1 toward the rear thereof. A direction from the top of the printer 1 toward the bottom thereof is indicated with an arrow Y therein. When viewed in a frontward direction, that is, a direction from the rear of the printer 1 toward the front thereof, a direction from the left-hand side of the printer 1 toward the right-hand side thereof is defined as a rightward direction whereas a direction from the right-hand side of the printer 1 toward the left-hand side thereof is defined as a leftward direction. In the following description, the terms "leftward", "rightward", "left side", and "right side" may be used on the basis of directional definition given above while referring to FIG. 1. FIG. 2 shows some components of the printer 1 in a left side view.

The printer 1 is capable of performing recording operation on recording paper 2 that is drawn from a paper roll 3. The paper roll 3, which is set inside the printer 1, is formed as a roll of elongated ribbon-like, tape-like, or belt-like recording paper 2. That is, the printer 1 prints an image and the like on a long strip of recording paper 2 that has been unrolled out of the paper roll 3. The paper roll 3 described herein is a non-limiting example of a roll object according to an aspect of at least one embodiment of the invention. The recording paper 2 described herein is a non-limiting example of a recording target medium according to an aspect of at least one embodiment of the invention. The printer 1 is provided with a paper roll housing unit 4, a paper transport mechanism 5, a recording mechanism 6, a guiding plate 7, and the like. The paper roll 3 is set inside the paper roll housing unit 4. The paper transport mechanism 5 draws the recording paper 2 downward from the paper roll 3 that is set in the paper roll housing unit 4, and then transports the recording paper 2 in a downstream direction. The recording mechanism 6 ejects ink onto the recording paper 2 so as to perform recording thereon. The guiding plate 7 supports the back of the recording paper 2 that has been unrolled out of the paper roll 3. Each of these paper roll housing unit 4, paper transport mechanism 5 recording mechanism 6, and guiding plate 7 is encased in a printer body case 8. The printer 1 has a leg part 9. The leg part 9 is provided under the printer body case 8. Being provided with the leg part 9, the printer 1 can be installed on a floor face or the like.

The paper roll housing unit 4 is provided at the upper part of the printer 1. The paper transport mechanism 5 and the recording mechanism 6 are provided below the paper roll housing unit 4. The recording paper 2 is drawn downward from the paper roll 3 by the paper transport mechanism 5. Then, the recording paper 2 is transported downward by the paper transport mechanism 5 while the reverse surface thereof is supported and guided by the guiding plate 7. The recording mechanism 6 performs recording operation on the recording paper 2 that is under downward transportation. After the recording mechanism 6 has printed an image or the like on the recording paper 2, the paper transport mechanism 5 further transports the recording paper 2 downward. Then, the recording paper 2 is ejected out of the printer 1 through a paper ejection port, which is not illustrated in the drawing. The paper ejection port is provided at the bottom region of the printer body case 8.

The paper roll 3 includes a hard pipe member 10 and a roll of recording paper 2. Specifically, a continuous strip of the recording paper 2 is wound around the pipe member 10, which functions as a core, so as to form the paper roll 3. The paper roll housing unit 4 is provided with a pair of roll support shafts 11L and 11R. The reference numeral 11L denotes the left one of the pair of roll support shafts. The reference numeral 11R denotes the right one thereof. The pipe member 10 has a left opening and a right opening. The left roll support shaft 11L is inserted in the cylindrical core member 10 through the left opening formed therein. The right roll support shaft 11R is inserted in the cylindrical core member 10 through the right opening formed therein. Being inserted through the openings of the pipe member 10, the roll support shafts 11L and 11R hold the paper roll 3 inside the paper roll housing unit 4. A paper roll motor 13 is indirectly connected to the left roll support shaft 11L with a train of gears 12 being interposed therebetween. The paper roll motor 13 described in this specification is a non-limiting example of a rotating section according to an aspect of at least one embodiment of the invention. On the other hand, the right roll support shaft 11R is configured as a free shaft of the printer 1 that can rotate freely. Because of such a structure, when the paper roll motor 13 is operated, which causes the rotation of the left roll support shaft 11L, the paper roll 3 rotates together with the pair of roll support shafts 11L and 11R while being supported by the pair of roll support shafts 11L and 11R.

As the paper roll motor 13, for example, a motor having an axial rotation torque of one hundred gram (100 g) or so is used. On the other hand, the roll support shafts 11L and 11R support the paper roll 3, which has a large mass. For example, the roll support shafts 11L and 11R hold the paper roll 3 having a weight of five kilogram (5 kg) or greater. Sometimes, the weight of the paper roll 3 exceeds ten kilogram (10 kg). For this reason, the speed reduction ratio of the gear train 12 is set at a large value such as 50-100 so as to ensure that, even when the pair of roll support shafts 11L and 11R must support such a heavy paper roll 3, it is still possible to rotate the paper roll 3.

The paper transport mechanism 5 performs the function of transporting the recording paper 2 that has been drawn out of the paper roll housing unit 4 in a downward direction, and then, ejecting the recording paper 2 out of the printer 1 through the ejection port that is not illustrated in the drawing. The paper transport mechanism 5 includes a paper transport master roller 15 and a paper transport slave roller 16. The paper transport master roller 15 is driven for rotation by a paper transport motor 14 (refer to FIG. 3). The paper transport slave roller 16 rotates as a driven roller in contact with the driving roller, that is, the paper transport master roller 15, under a contact urging force. The paper transport master roller 15 is hereafter simply referred to as the paper transport roller 15. The paper transport slave roller 16 is hereafter simply referred to as the slave roller 16. The paper transport roller 15 is connected to the output shaft of the paper transport motor 14. The ratio of the rotation amount of the output shaft of the paper transport motor 14 to the rotation amount of the paper transport roller 15 is 1:1. This means that the ratio of speed reduction from the paper transport motor 14 to the paper transport roller 15 is one.

The recording paper 2 unrolled out of the paper roll 3 is pinched between the paper transport roller 15 and the slave roller 16. Under the rotation force of the paper transport roller 15, the recording paper 2 is transported in a downward direction. During the downward transportation of the recording paper 2, the paper roll motor 13 is driven so as to rotate the paper roll 3 in a direction that causes the recording paper 2 to be fed out of the paper roll 3, which might be hereafter referred to as a forward direction or a normal rotation direction. That is, the recording paper 2 is transported from the upstream side of a paper transport path to the downstream side thereof in a downward direction as a result of the rotation of the paper transport roller 15, which is driven by the paper transport motor 14, and the forward rotation of the paper roll 3, which is driven by the paper roll motor 13.

When recording operation is performed, the rotation of the paper roll motor 13 is controlled so that the speed of the rotation of the paper roll 3 is slightly lower than the speed of the transportation of the recording paper 2 that is performed by the paper transport mechanism 5. The reason why the rotation of the paper roll motor 13 is controlled as explained above is to ensure that the recording paper 2 is properly tensioned so that no slack (i.e., loosening, sag, or the like) is formed between the paper transport mechanism 5 and the paper roll 3 during the recording operation. Therefore, the paper roll motor 13 rotates while applying a braking force to the transportation of the recording paper 2 performed by the paper transport mechanism 5, the braking force being drawn as a result of the transportation of the recording paper 2 performed by the paper transport mechanism 5 in such a manner that the tension of the recording paper 2 is not lost.

A rotary encoder 17 (refer to FIG. 3) is mounted on the output shaft of the paper roll motor 13 explained above. The rotary encoder 17 detects the amount of the rotation of the paper roll 3. The rotary encoder 17 described in this specification is a non-limiting example of a roll object rotation amount detecting section according to an aspect of at least one embodiment of the invention. A rotary encoder 18 (refer to FIG. 3) is mounted on the output shaft of the paper transport motor 14. With such a structure, it is possible to detect the rotation amount of the paper roll motor 13 and the rotation speed thereof with the use of the rotary encoder 17. In addition, it is possible to detect the rotation amount of the paper transport motor 14 and the rotation speed thereof with the use of the rotary encoder 18.

The recording mechanism 6 includes a recording head 19, a carriage 20, a carriage guide shaft 21, a carriage motor 22 (refer to FIG. 3), and the like. The recording head 19 is mounted on the carriage 20. The carriage guide shaft 21 guides the movement of the carriage 20 in the leftward/rightward direction, that is, in the main scan direction. The carriage motor 22 moves the carriage 20 in the leftward/rightward direction by transmitting motor power via a timing belt to the carriage 20. The timing belt is not illustrated in the drawing. Upon receiving the driving power of the carriage motor 22, the carriage 20 reciprocates in the leftward/rightward direction along the carriage guide shaft 21. The recording head 19 reciprocates together with the carriage 20 in the leftward/rightward direction. Through the reciprocation of the recording head 19 in the leftward/rightward direction and the downward movement of the recording paper 2 by the paper transport mechanism 5, the recording head 19 is moved to a predetermined position on the recording paper 2 so as to perform recording thereon.

Circuit Block Configuration

Next, with reference to FIG. 3, the electric configuration of the printer 1 that is illustrated in FIGS. 1 and 2 is explained below.

Figure 3:
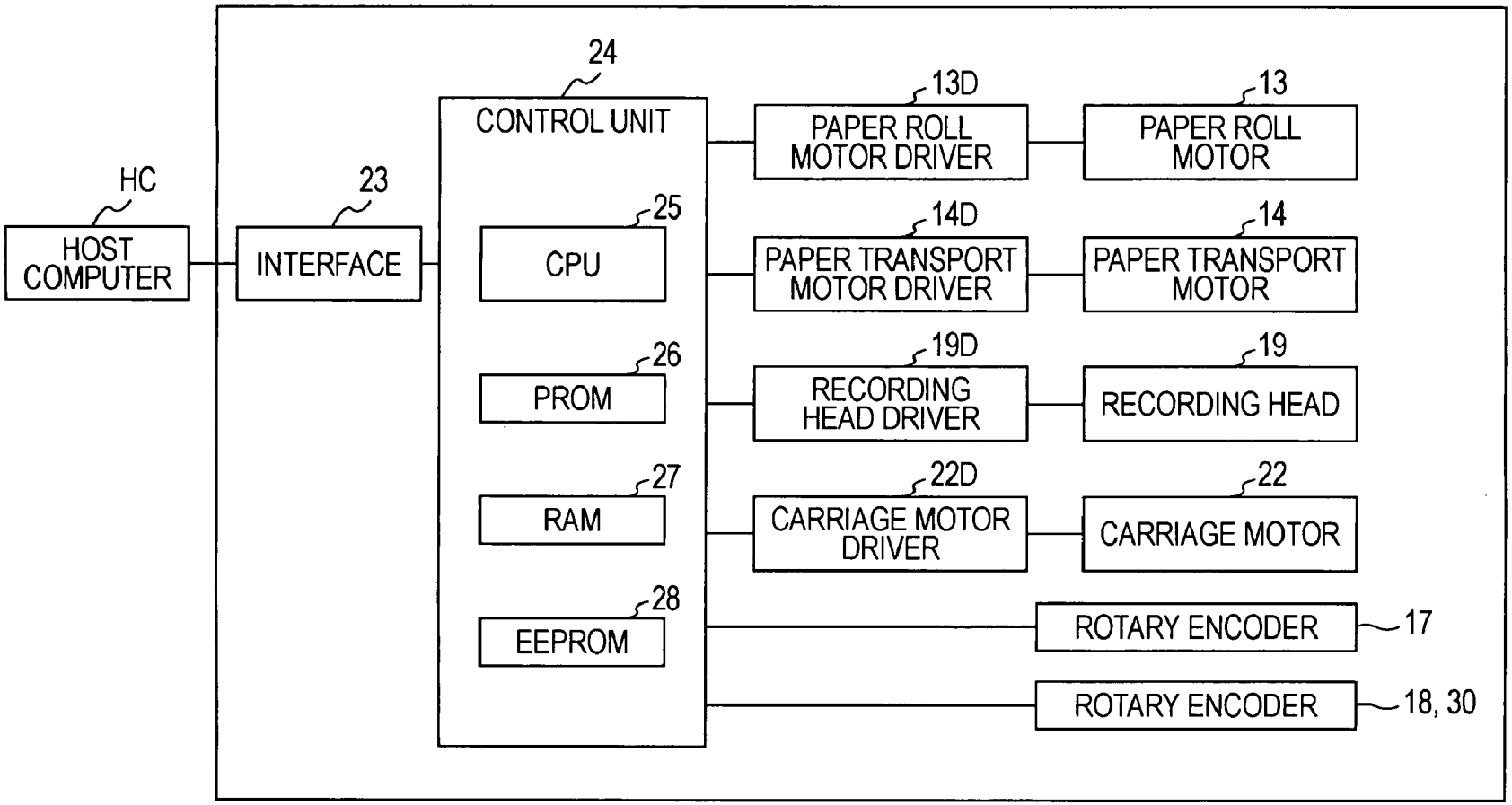
FIG. 3 is a circuit block diagram that schematically illustrates an example of the electric configuration of the printer according to an exemplary embodiment of the invention.

As illustrated in FIG. 3, the printer 1 includes an interface 23, a control unit 24, the paper roll motor 13, a paper roll motor driver 13D, the paper transport motor 14, a paper transport motor driver 14D, the recording head 19, a recording head driver 19D, the carriage motor 22, a carriage motor driver 22D, the rotary encoder 17, the rotary encoder 18, and the like. The interface 23 receives image formation data and other data that are inputted from a host computer HC. The paper roll motor driver 13D drives the paper roll motor 13. The paper transport motor driver 14D drives the paper transport motor 14. The recording head driver 19D drives and controls the recording head 19. The carriage motor driver 22D drives the carriage motor 22.

The control unit 24 includes a central processing unit (CPU) 25, a programmable read-only memory (PROM) 26, a random access memory (RAM) 27, an electrically erasable programmable read-only memory (EEPROM) 28, and the like. The PROM 26 stores, for example, processing programs that are to be used for various kinds of operations of the printer 1. The RAM 27 functions as a memory into which image formation data and other data that are inputted from the host computer HC are stored/memorized. The RAM 27 further functions as a work area memory. The EEPROM 28 memorizes various kinds of information related to the printer 1. On the basis of a recording start signal, image formation data, and the like, the CPU 25 controls the recording operation of the recording head 19. In addition, the CPU 25 functions as an example of a rotation controlling section according to an aspect of at least one embodiment of the invention, which controls the rotation of the paper roll motor 13. Moreover, the CPU 25 controls the driving operation of the paper transport motor 14, the carriage motor 22, and the like. Furthermore, the CPU 25 performs various kinds of operations of the printer 1. As a modification example of the configuration explained above, the host computer HC may be used as a substitute for the control unit 24 or the CPU 25.

Printer Operation: First Approach for Measuring Diameter of Paper Roll

Figure 4:
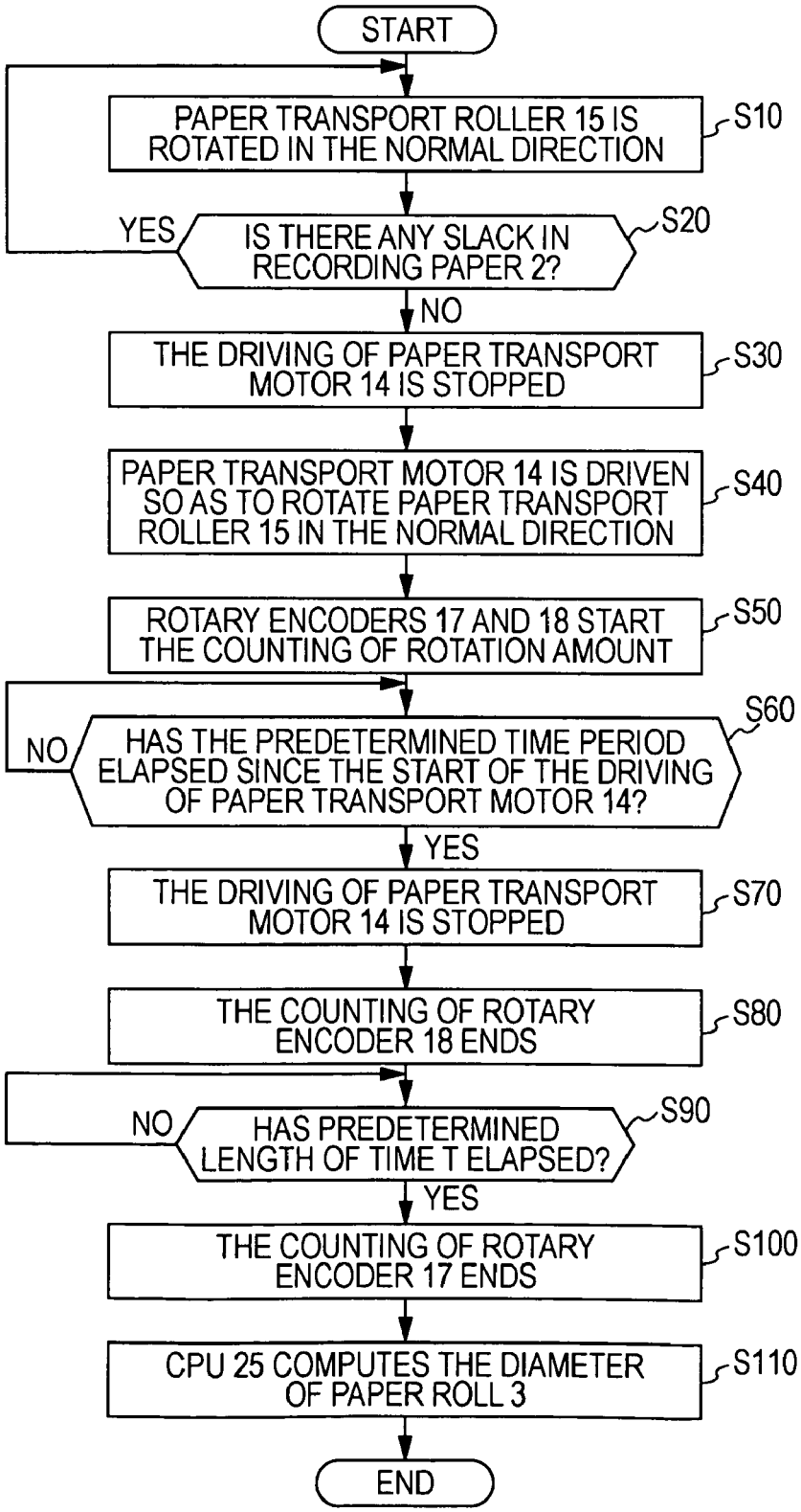
FIG. 4 is a flowchart that schematically illustrates an example of the operation of the printer according to an exemplary embodiment of the invention that is performed at the time of the measurement of the diameter of a paper roll.
Figure 5:
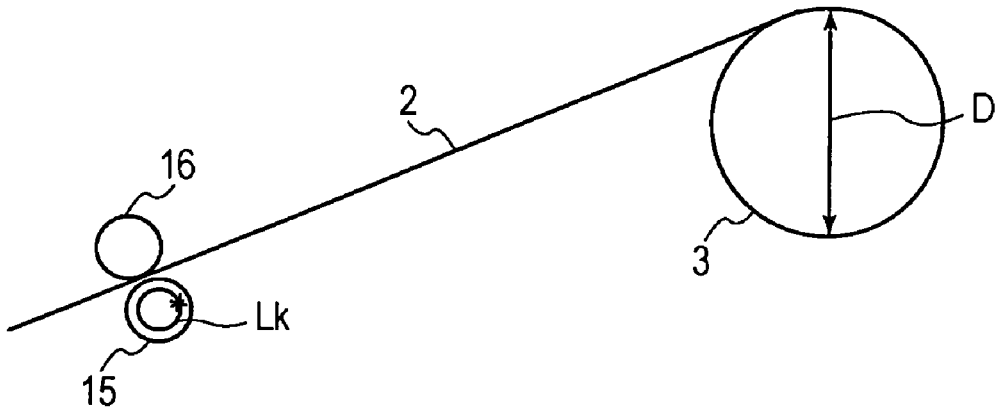
FIG. 5 is a diagram that schematically illustrates an example of the relationship between the transportation of recording paper performed by a paper transport roller and the rotation of the paper roll according to an exemplary embodiment of the invention.
Figure 6:
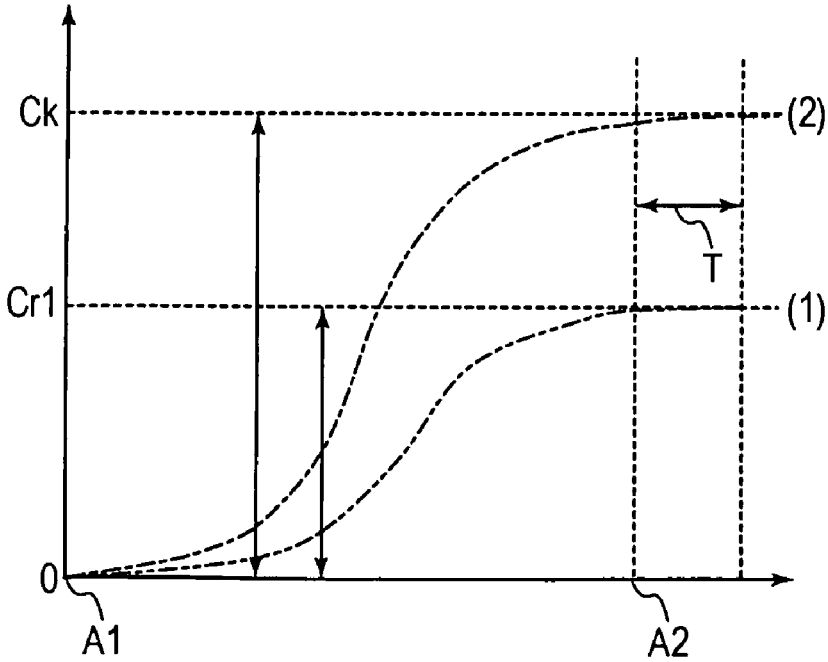
FIG. 6 is a graph that shows an example of a change in the count amount of rotary encoders according to an exemplary embodiment of the invention.

The printer 1 is configured to measure the diameter of the paper roll 3 and then control the rotation of the paper roll motor 13 on the basis of the measured diameter. First of all, with reference to FIGS. 4, 5, and 6, the operation of the printer 1 that is performed when the diameter of the paper roll 3 is measured is explained below. FIG. 4 is a flowchart that schematically illustrates an example of the operation of the printer 1 that is performed at the time of the measurement of the diameter of the paper roll 3. FIG. 5 is a diagram that schematically illustrates an example of the relationship between the transportation of the recording paper 2 performed by the paper transport mechanism 5 and the rotation of the paper roll 3. FIG. 6 is a graph that shows an example of a change in the count value (i.e., count amount) of each of the rotary encoders 17 and 18 that occurs at the time of the measurement of the diameter of the paper roll 3. That is, the graph of FIG. 6 shows a change in the rotation amount of the paper roll motor 13 and a change in the rotation amount of the paper transport motor 14.

The measurement of the diameter of the paper roll 3 is performed in a measurement mode. The measurement mode is a mode that is different from a recording operation mode in which recording operation is performed. The measurement mode in which the diameter of the paper roll 3 is measured is executed when a user manually operates predetermined mode selection buttons or the like. In addition to such manual execution, the measurement mode may be automatically initiated. For example, the measurement mode may be executed automatically at the time when the printer 1 is powered ON. Or, the measurement mode may be executed automatically at each time when recording operation is continued for a predetermined length of time. As another example, the measurement mode may be executed automatically at each time when the recording paper 2 is transported by a predetermined paper length.

If it is assumed that there is not any slippage between the paper transport roller 15 and the recording paper 2, and further if it is assumed that there is not any slippage between the paper roll motor 13 and the recording paper 2, the amount of the transportation of the recording paper 2 is equal to the amount of the rotation of the paper roll 3 on the circumferential surface thereof when the paper roll 3 rotates as the recording paper 2 is transported. For this reason, if the amount of the transportation of the recording paper 2 is measured as a measurement value that indicates the amount of the rotation of the paper roll 3 on the circumferential surface thereof, and further if the rotation angle of the paper roll 3 that corresponds to the amount of the rotation of the paper roll 3 on the circumferential surface thereof is found, it is possible to calculate the diameter of the paper roll 3 on the basis of the relationship between the circumference of a circle and the diameter thereof.

As an approach for measuring the diameter of the paper roll 3 according to the present embodiment of the invention, in addition to the measurement of the transportation amount of the recording paper 2, the rotation angle of the paper roll 3, which rotates as the recording paper 2 is transported, is also measured. Then, on the basis of these measurement results, the diameter of the paper roll 3 is calculated. The amount of the transportation of the recording paper 2 corresponds to the amount of the rotation of the paper transport roller 15. The rotation amount of the paper transport roller 15 can be measured with the use of the rotary encoder 18. The circumferential length of the paper transport roller 15 is known as a predetermined fixed value. In addition, it is possible to measure how many times the paper transport roller 15 has rotated in order to transport the recording paper 2 on the basis of the count amount of the rotary encoder 18. Therefore, it is possible to calculate the transportation amount of the recording paper 2 on the basis of the known circumferential length of the paper transport roller 15 and further on the basis of the count amount of the rotary encoder 18, which corresponds to the amount of the rotation of the paper transport roller 15 that has rotated so as to transport the recording paper 2. In such calculation of the transportation amount of the recording paper 2, the rotary encoder 18 described herein functions as an example of a transportation amount detecting section according to an aspect of at least one embodiment of the invention, which detects the transportation amount of the recording paper 2.

At the time when the rotation angle of the paper roll 3 is measured, if an idling condition in which the paper roll 3 is not rotating even though the recording paper 2 is being transported occurs, which means that the recording paper 2 is not sufficiently tensioned between the paper transport roller 15 and the paper roll 3, it is not possible to measure the rotation angle of the paper roll 3 corresponding to the transportation amount of the recording paper 2 successfully. Therefore, in such a condition, it is not possible to calculate the diameter of the paper roll 3 accurately.

In order to avoid such a calculation failure, as a first step of the measurement mode, "paper slack elimination" operation (i.e., tensioning operation) is performed (step S10). In the tensioning operation of the step S10, the slack of the recording paper 2, if any, is eliminated so that the recording paper 2 should have an adequate tension between the paper transport roller 15 and the paper roll 3. In this paper slack elimination of the step S10, the paper transport motor 14 is driven so as to rotate the paper transport roller 15 in a direction that causes the recording paper 2 to be transported downward, that is, in the direction of normal rotation. In the next step, it is judged whether there is any slack in the recording paper 2 between the paper transport roller 15 and the paper roll 3 or not (step S20). If it is judged that there is a slack in the recording paper 2 (step S20: YES), or, in other words, if it is judged that the recording paper 2 is not tensioned enough in the step S20, the rotation of the paper transport roller 15 in the direction of normal rotation is continued. If it is judged that there is no slack in the recording paper 2 (step S20: NO), or, in other words, if it is judged that the recording paper 2 is tensioned enough in the step S20, the driving operation of the paper transport motor 14 is stopped (step S30).

The judgment as to whether there is a sag in the position (i.e., lack of tension) of the recording paper 2 between the paper transport roller 15 and the paper roll 3 or not can be made on the basis of, for example, the duty ratio of PWM voltage control in a voltage that is applied to the paper transport motor 14. Specifically, under the condition that the paper transport roller 15 is rotated at a certain speed, if the duty ratio is not greater than a predetermined threshold value, it is possible to judge that the burden (i.e., load) of the rotation of the paper transport motor 14 is relatively small and that there is a slack in the recording paper 2. On the other hand, if the duty ratio is greater than the predetermined threshold value, it is possible to judge that the burden of the rotation of the paper transport motor 14 is relatively large and that the recording paper 2 is adequately tensioned between the paper transport roller 15 and the paper roll 3.

If it is judged that there is no slack in the recording paper 2 between the paper transport roller 15 and the paper roll 3 (step S20: NO), subsequent to the pausing of the driving operation of the paper transport motor 14 (step S30), the paper transport motor 14 is driven for a predetermined time period, for example, for five seconds, so as to rotate the paper transport roller 15 in the direction of normal rotation (step S40). The recording paper 2 is transported downward as the paper transport roller 15 rotates. In addition, the paper roll 3 rotates in the direction of normal rotation as the recording paper 2 is transported downward. As the paper roll 3 rotates, the paper roll motor 13 that is indirectly connected to the paper roll 3 with the gear train 12 being interposed therebetween also rotates.

In synchronization with the start of the driving operation of the paper transport motor 14, the rotary encoders 18 and 17 start the detection of the rotation amount of the paper transport motor 14 and the rotation amount of the paper roll motor 13, respectively (step S50). That is, as illustrated in FIG. 6, the detection of the rotation amount of the paper transport motor 14 and the rotation amount of the paper roll motor 13 is started at a detection start point in time, which is denoted as A1. In the graph of FIG. 6, the horizontal axis represents time elapsed from the start of the driving operation of the paper transport motor 14. The vertical axis thereof represents the rotation amount of each of the rotary encoders 17 and 18. The count amount of each of the rotary encoders 17 and 18 is zero at the detection start point in time A1. The curve (1) in the graph of FIG. 6 represents the count amount of the rotary encoder 17. The curve (2) in the graph of FIG. 6 represents the count amount of the rotary encoder 18. As understood from the graph of FIG. 6, the count amount of each of the rotary encoders 17 and 18 increases with the passage of time during the driving of the paper transport motor 14.

After the continuous driving of the paper transport motor 14 for a certain time period, or, in other words, if it is judged that the predetermined time period has elapsed since the start of the driving of the paper transport motor 14 (in FIG. 4, step S60: YES), the driving of the paper transport motor 14 is stopped (step S70). In synchronization with the stopping of the operation of the paper transport motor 14, the count amount of the rotary encoder 18 is measured (step S80). For example, as shown in the graph of FIG. 6, the count amount of the rotary encoder 18 is measured as Ck at a driving stop point in time A2 at which the driving of the paper transport motor 14 is stopped. After the measurement of the count amount of the rotary encoder 18, it is judged whether predetermined length of time T, for example, 0.1 second, has elapsed or not (step S90). After the lapse of the predetermined length of time T (step S90: YES), the count amount of the rotary encoder 17 is measured (step S100). For example, as shown in the graph of FIG. 6, the count amount of the rotary encoder 17 at such a point in time is measured as Cr1.

The recording paper 2 has inherent elasticity, that is, elasticity of its own. Because of the intrinsic elasticity thereof, tension acts on the recording paper 2 between the paper roll 3 and the paper transport roller 15. For this reason, even after the rotation of the paper transport roller 15 has stopped as a result of the stopping of the driving operation of the paper transport motor 14, the paper roll 3 sometimes rotates slightly due to the effects of an elastic force that is inherent in the recording paper 2 though not necessarily limited thereto. In such a case, the paper roll motor 13 also rotates, which is caused by the slight rotation of the paper roll 3. In view of the foregoing, the measurement of the count amount of the rotary encoder 17 is conducted only after the lapse of a certain waiting time period that is long enough so that, after the stopping of the driving of the paper transport motor 14, the rotation of the paper roll motor 13 will have been completely stopped by the end of the waiting time period. With such a configuration, it is possible to increase the measurement accuracy of the rotation amount of the paper roll 3 corresponding to the transportation amount of the recording paper 2.

As the next step, the CPU 25 computes the diameter of the paper roll 3 on the basis of the rotation amount Cr1 of the paper roll motor 13, which has been measured with the use of the rotary encoder 17, and further on the basis of the rotation amount Ck of the paper transport motor 14, which has been measured with the use of the rotary encoder 18 (step S110). In the operation explained herein, the CPU 25 functions as an example of a computing section according to an aspect of at least one embodiment of the invention, which computes the diameter of a roll object (e.g., the paper roll 3) according to an aspect of at least one embodiment of the invention. Therefore, a combination of the CPU 25, the rotary encoder 17, and the rotary encoder 18 constitutes an example of a roll object diameter measuring section according to an aspect of at least one embodiment of the invention. Note that the rotary encoder 17 described in this specification is a non-limiting example of the roll object rotation amount detecting section according to an aspect of at least one embodiment of the invention as explained earlier. In addition, as also explained earlier, the rotary encoder 18 described in this specification is a non-limiting example of the transportation amount detecting section according to an aspect of at least one embodiment of the invention. The diameter of the paper roll 3 can be calculated using the following formula.

$$Lk\times(Ck/Rk)=D\times\Pi\times(Cr1/Rr) \quad (1)$$

$$D=(Lk\times(Ck/Rk))/(\Pi\times(Cr1/Rr)) \quad (2)$$

where,

Lk: the circumferential length of the paper transport roller 15

Ck: the count amount of the rotary encoder 18

Rk: the count amount of the rotary encoder 18 at the time of one rotation (i.e., rotation by 360°) of the paper transport motor 14 (the paper transport roller 15)

D: the diameter of the paper roll 3

Π: the ratio of the circumference to its diameter (circular constant)

Cr1: the count amount of the rotary encoder 17

Rr: the count amount of the rotary encoder 17 for the paper roll motor 13 at the time of 360-degree rotation of the paper roll 3; this value equals to the count amount of the rotary encoder 17 corresponding to 360-degree rotation of the paper roll motor 13 multiplied by the speed reduction ratio of the gear train 12

Each of Cr1 and Ck is a measurement value. On the other hand, each of Lk, Rk, and Rr is a known value that is unique to the printer 1 and has been measured in advance.

The left-hand side of the equation (1) shown above represents the amount of the rotation of the paper transport roller 15 at the outer circumference thereof at the time of the rotation of the paper transport motor 14 by the count amount Ck, that is, at the time of the Ck/Rk rotation of the paper transport motor 14. That is, if it is assumed that there occurs no slippage between the paper transport roller 15 and the recording paper 2, the left-hand side of the equation (1) shown above equals to the amount of the transportation of the recording paper 2. On the other hand, the right-hand side of the equation (1) shown above represents the amount of the rotation of the paper roll 3 at the outer circumference thereof at the time of the rotation of the paper roll motor 13 by the count amount Cr1, that is, at the time of the Cr1/Rr rotation of the paper roll 3. That is, if it is assumed that there occurs no slippage between the paper roll 3 and the recording paper 2, the right-hand side of the equation (1) shown above also equals to the amount of the transportation of the recording paper 2. Thus, it is possible to calculate the diameter D of the paper roll 3 on the basis of the equation (2), which can be derived as a result of the mathematical changing of the equation (1).

Printer Operation: Second Approach for Measuring Diameter of Paper Roll

Next, with reference to FIGS. 7, 8, and 9, another approach for measuring the diameter of the paper roll 3 is explained below. In the following description of the second approach for measuring the diameter of the paper roll 3 according to the present embodiment of the invention, the same reference numerals are consistently used for the same components as those of the printer 1 that executes the first approach for measuring the diameter of the paper roll 3 explained above so as to omit any redundant explanation or simplify explanation thereof. The electric configuration of a printer that executes the second approach explained below is the same as that used for the first approach explained above except that the rotary encoder 18 that is illustrated in the electric block diagram of FIG. 3 is replaced with a rotary encoder 30. Note that the same reference numeral 1 as above is used to refer to the printer that executes the second approach explained below irrespective of such a minor difference in the electric configuration therebetween. In the following description of this specification, the printer that executes the second approach may be referred to as the printer 1 according to the second embodiment of the invention whereas the printer that executes the first approach may be referred to as the printer 1 according to the first embodiment of the invention.

The calculation of the diameter of the paper roll 3 that is performed by the printer 1 according to the first embodiment of the invention can be briefly summarized as follows. The paper transport motor 14 is driven so as to rotate the paper transport roller 15. Because of the rotation of the paper transport roller 15, the recording paper 2 is transported downward. As the recording paper 2 is transported downward, the paper roll 3 and the paper roll motor 13, the latter of which is indirectly connected to the former through the gear train 12, rotate. The rotation amount of each of the paper transport motor 14 and the paper roll motor 13 is detected. Then, the diameter of the paper roll 3 is calculated on the basis thereof. In contrast, the printer 1 according to the second embodiment of the invention is provided with a transport detection roller 29. The transport detection roller 29 functions as a driven roller (i.e., follower roller) that rotates freely when the recording paper 2 is transported. The rotary encoder 30 is mounted on the rotation shaft of the transport detection roller 29. Being mounted thereon, the rotary encoder 30 detects the amount of the rotation of the transport detection roller 29. The rotary encoder 30 described herein functions as an example of a driven roller rotation amount detecting section according to an aspect of at least one embodiment of the invention.

When the paper roll 3 is rotated in the reverse direction so as to re-roll (i.e., take up) the recording paper 2, that is, roll the recording paper 2 back to the paper roll 3, the recording paper 2 is transported upward. The transport detection roller 29 rotates when the recording paper 2 is transported in the re-rolling upward direction. The printer 1 according to the second embodiment of the invention detects the rotation amount of the transport detection roller 29, which rotates due to the upward transportation of the recording paper 2, and further detects the rotation amount of the paper roll motor 13, which drives the paper roll 3 so as to cause the reverse rotation thereof. Then, on the basis of the rotation amount of the transport detection roller 29 and the rotation amount of the paper roll motor 13, the diameter of the paper roll 3 is calculated.

Figure 7:
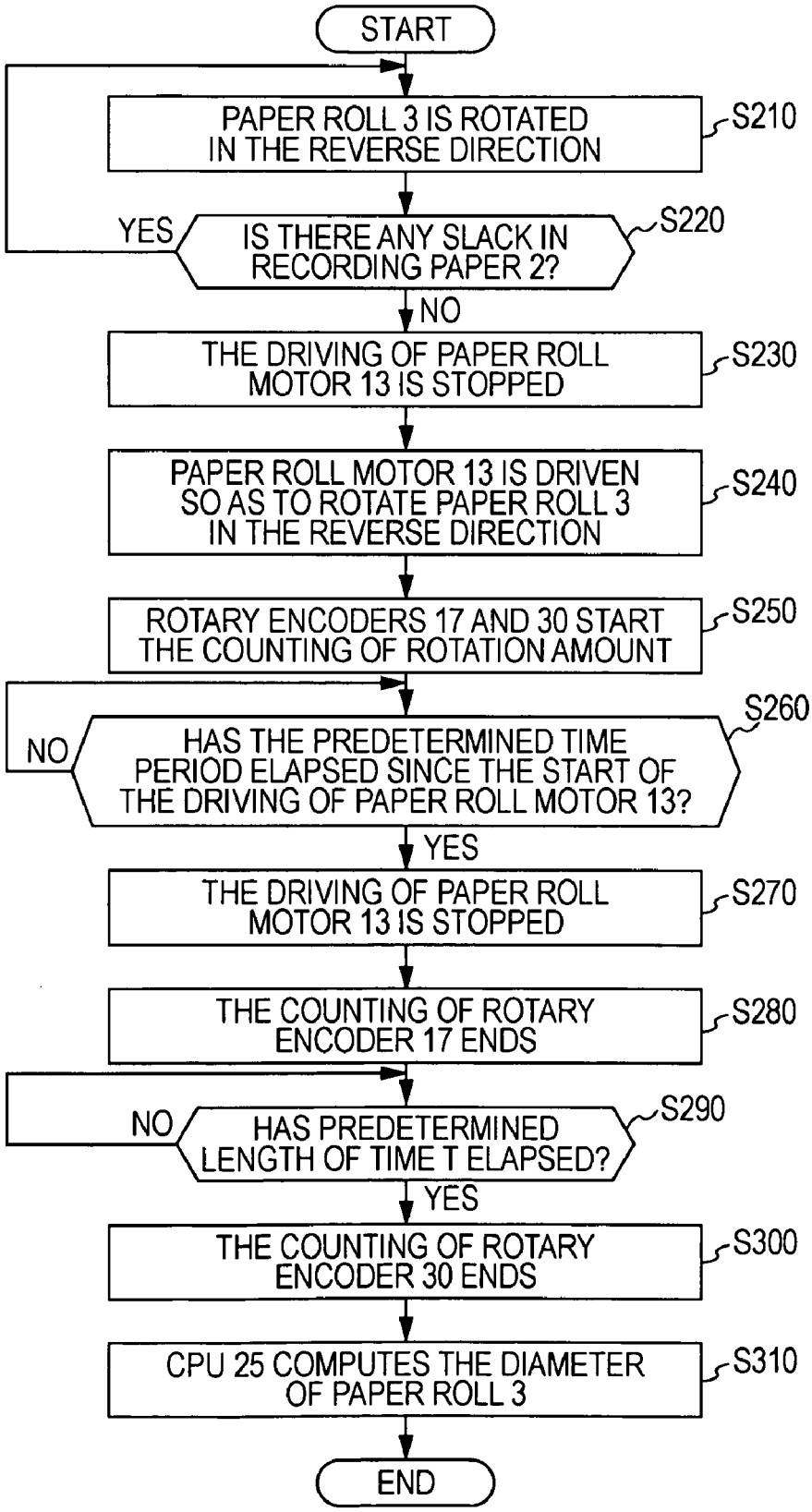
FIG. 7 is a flowchart that schematically illustrates another example of the operation of the printer according to an exemplary embodiment of the invention that is performed at the time of the measurement of the diameter of the paper roll.

FIG. 7 is a flowchart that schematically illustrates another example of the operation of the printer 1 that is performed at the time of the measurement of the diameter of the paper roll 3. FIG. 8 is a diagram that schematically illustrates an example of the relationship between the upward transportation of the recording paper 2 due to the rotation of the paper roll 3 and the rotation of the transport detection roller 29. FIG. 9 is a graph that shows an example of a change in the count amount of each of the rotary encoders 17 and 30 that occurs at the time of the measurement of the diameter of the paper roll 3. That is, the graph of FIG. 9 shows a change in the rotation amount of the paper roll motor 13 and a change in the rotation amount of the transport detection roller 29.

Figure 8:
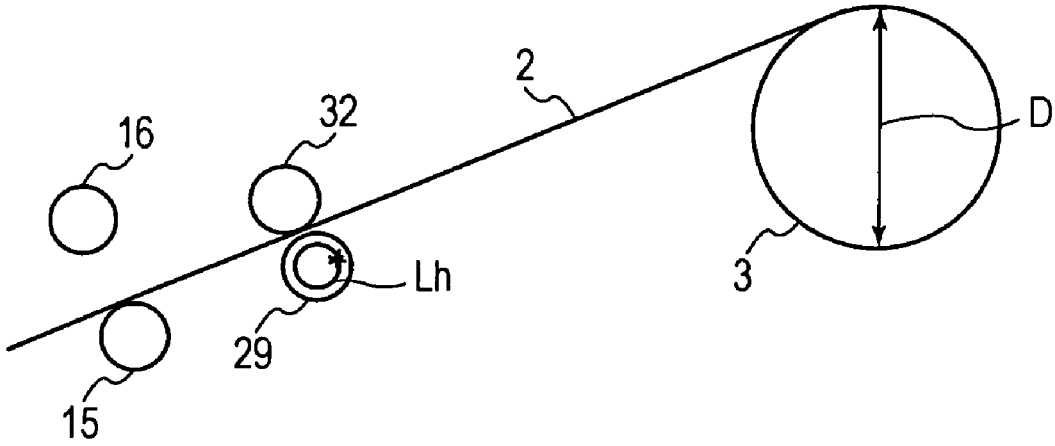
FIG. 8 is a diagram that schematically illustrates an example of the relationship between the transportation of recording paper performed by the paper transport roller and the rotation of the paper roll of the printer that performs the operation illustrated in the flowchart of FIG. 7.

As illustrated in FIG. 8, the transport detection roller 29 is provided between the paper roll 3 and the paper transport roller 15. A slave roller 32 is provided over the transport detection roller 29. The slave roller 32 rotates as a driven roller in contact with the transport detection roller 29 under a contact urging force. That is, the recording paper 2 is rolled out onto the circumferential surface of the paper transport roller 15 through a roller contact point between the transport detection roller 29 and the slave roller 32.

Figure 9:
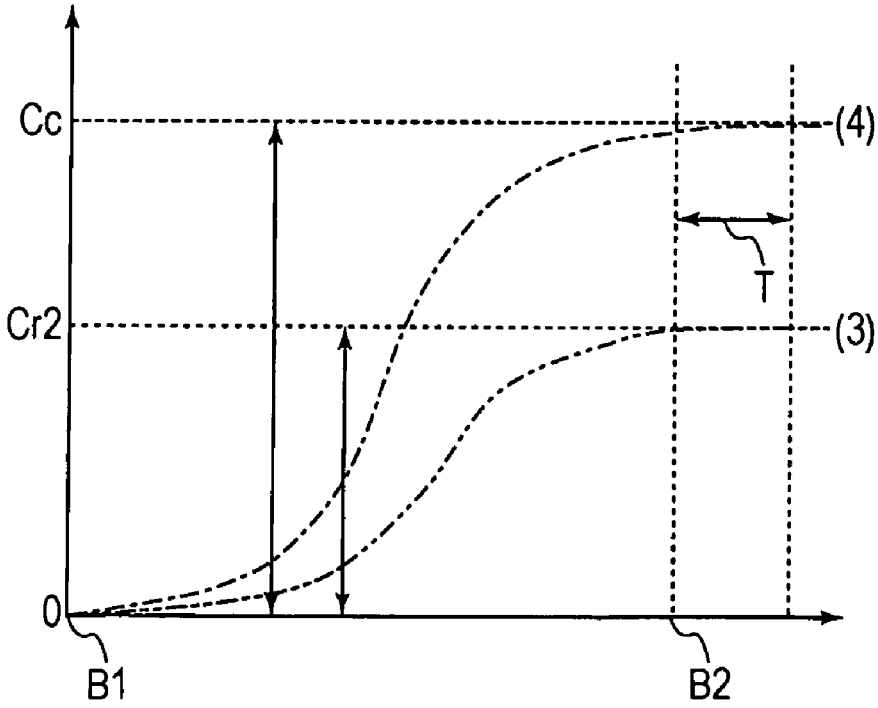
FIG. 9 is a graph that shows an example of a change in the count amount of rotary encoders of the printer that performs the operation illustrated in the flowchart of FIG. 7.

With reference to FIGS. 7, 8, and 9, the operation of the printer 1 that is performed when the diameter of the paper roll 3 is measured is explained below.

As preparatory operation that is performed prior to the execution of the measurement mode, the slave roller 16 is retracted away from the recording paper 2 through the manual instructions given by a user or the automatic control operation of the printer 1. In addition to the retraction of the slave roller 16, the recording paper 2 is put into a nip state between the transport detection roller 29 and the slave roller 32. The nip state means that the recording paper 2 is pinched between the transport detection roller 29 and the slave roller 32. The measurement mode is executed after the preparatory retraction of the slave roller 16 and the preparatory nipping of the recording paper 2.

As a first step of the measurement mode, paper slack elimination operation, that is, tensioning operation, is performed (step S210). In the tensioning operation of the step S210, the slack of the recording paper 2, if any, is eliminated so that the recording paper 2 should have an adequate tension between the paper transport roller 15 and the paper roll 3. In this paper slack elimination of the step S210, the paper roll motor 13 is driven so as to rotate the paper roll 3 in a direction that causes the recording paper 2 to be transported upward, that is, in the direction of reverse rotation. In the next step, it is judged whether there is any slack in the recording paper 2 between the paper roll 3 and the transport detection roller 29 or not (step S220). If it is judged that there is a slack in the recording paper 2 (step S220: YES), or, in other words, if it is judged that the recording paper 2 is not tensioned enough in the step S220, the rotation of the paper roll 3 in the direction of reverse rotation is continued. If it is judged that there is no slack in the recording paper 2 (step S220: NO), or, in other words, if it is judged that the recording paper 2 is tensioned enough in the step S220, the driving operation of the paper roll motor 13 is stopped (step S230).

The judgment as to whether there is a sag in the position, that is, lack of tension, of the recording paper 2 between the paper roll 3 and the transport detection roller 29 or not can be made on the basis of, for example, the duty ratio of PWM voltage control in a voltage that is applied to the transport detection roller 29.

If it is judged that there is no slack in the recording paper 2 between the paper roll 3 and the transport detection roller 29 (step S220: NO), subsequent to the pausing of the driving operation of the paper roll motor 13 (step S230), the paper roll motor 13 is driven for a predetermined time period, for example, for five seconds, so as to rotate the paper roll 3 in the direction of reverse rotation (step S240). Due to the reverse rotation of the paper roll 3, the recording paper 2 is transported upward. As the recording paper 2 is transported upward, the transport detection roller 29 rotates in the direction of the reverse rotation.

In synchronization with the start of the driving operation of the paper roll motor 13, the rotary encoders 17 and 30 start the detection of the rotation amount of the paper roll motor 13 and the rotation amount of the transport detection roller 29, respectively (step S250). That is, as illustrated in FIG. 9, the detection of the rotation amount of the paper roll motor 13 and the rotation amount of the transport detection roller 29 is started at a detection start point in time, which is denoted as B1. In the graph of FIG. 9, the horizontal axis represents time elapsed from the start of the driving operation of the paper roll motor 13. The vertical axis thereof represents the rotation amount of each of the rotary encoders 17 and 30. The count amount of each of the rotary encoders 17 and 30 is zero at the detection start point in time B1. The curve (3) in the graph of FIG. 9 represents the count amount of the rotary encoder 17. The curve (4) in the graph of FIG. 9 represents the count amount of the rotary encoder 30. As understood from the graph of FIG. 9, the count amount of each of the rotary encoders 17 and 30 increases with the passage of time during the driving of the paper roll motor 13.

After the continuous driving of the paper roll motor 13 for a certain time period, or, in other words, if it is judged that the predetermined time period has elapsed since the start of the driving of the paper roll motor 13 (step S260: YES), the driving of the paper roll motor 13 is stopped (step S270). In synchronization with the stopping of the operation of the paper roll motor 13, the count amount of the rotary encoder 17 is measured (step S280). For example, as shown in the graph of FIG. 9, the count amount of the rotary encoder 17 is measured as Cr2 at a driving stop point in time B2 at which the driving of the paper roll motor 13 is stopped. After the measurement of the count amount of the rotary encoder 17, it is judged whether predetermined length of time T, for example, 0.1 second, has elapsed or not (step S290). After the lapse of the predetermined length of time T (step S290: YES), the count amount of the rotary encoder 30 is measured (step S300). For example, as shown in the graph of FIG. 9, the count amount of the rotary encoder 30 at such a point in time is measured as Cc.

As explained earlier, the recording paper 2 slightly has inherent elasticity, that is, elasticity of its own. Because of the intrinsic elasticity thereof, tension acts on the recording paper 2 between the paper roll 3 and the transport detection roller 29. For this reason, even after the rotation of the paper roll 3 has stopped as a result of the stopping of the driving operation of the paper roll motor 13, the transport detection roller 29 sometimes rotates slightly due to the effects of an elastic force that is inherent in the recording paper 2 though not necessarily limited thereto. In view of the foregoing, the measurement of the count amount of the rotary encoder 30 is conducted only after the lapse of a certain waiting time period that is long enough so that, after the stopping of the driving of the paper roll motor 13, the rotation of the transport detection roller 29 will have been completely stopped by the end of the waiting time period. With such a configuration, it is possible to increase the measurement accuracy of the rotation amount of the paper roll 3 corresponding to the transportation amount of the recording paper 2.

As the next step, the CPU 25 computes the diameter of the paper roll 3 on the basis of the rotation amount Cc of the transport detection roller 29, which has been measured with the use of the rotary encoder 30, and further on the basis of the rotation amount Cr2 of the paper roll motor 13, which has been measured with the use of the rotary encoder 17 (step S310). In the operation explained herein, the CPU 25 functions as an example of the computing section mentioned earlier. Therefore, a combination of the CPU 25, the rotary encoder 17, and the rotary encoder 30 constitutes another example of the roll object diameter measuring section mentioned earlier. Note that the rotary encoder 17 described in this specification is a non-limiting example of the roll object rotation amount detecting section according to an aspect of at least one embodiment of the invention as explained earlier. In addition, as also explained earlier, the rotary encoder 30 described in this specification is a non-limiting example of the driven roller rotation amount detecting section according to an aspect of at least one embodiment of the invention. The diameter of the paper roll 3 can be calculated using the following formula.

$$Lh\times(Cc/Rh)=D\times\Pi\times(Cr2/Rr) \quad (3)$$

$$D=(Lh\times(Cc/Rh))/(\Pi\times(Cr2/Rr)) \quad (4)$$

where,

Lh: the circumferential length of the transport detection roller 29

Cc: the count amount of the rotary encoder 30

Rh: the count amount of the rotary encoder 30 at the time of 360-degree rotation of the transport detection roller 29

D: the diameter of the paper roll 3

Π: the ratio of the circumference to its diameter

Cr2: the count amount of the rotary encoder 17

Rr: the count amount of the rotary encoder 17 for the paper roll motor 13 at the time of 360-degree rotation of the paper roll 3; this value equals to the count amount of the rotary encoder 17 corresponding to a 360-degree rotation of the paper roll motor 13 multiplied by the speed reduction ratio of the gear train 12

Each of Cr2 and Cc is a measurement value. On the other hand, each of Lh, Rh, and Rr is a pre-measured known value.

The left-hand side of the equation (3) shown above represents the amount of the rotation of the transport detection roller 29 at the outer circumference thereof at the time of the rotation of the transport detection roller 29 by the count amount Cc, that is, at the time of the Cc/Rh rotation of the transport detection roller 29. That is, if it is assumed that there occurs no slippage between the transport detection roller 29 and the recording paper 2, the left-hand side of the equation (3) shown above equals to the amount of the transportation of the recording paper 2. On the other hand, the right-hand side of the equation (3) shown above represents the amount of the rotation of the paper roll 3 at the outer circumference thereof at the time of the rotation of the paper roll motor 13 by the count amount Cr2, that is, at the time of the Cr2/Rr rotation of the paper roll 3. That is, if it is assumed that there occurs no slippage between the paper roll 3 and the recording paper 2, the right-hand side of the equation (3) shown above also equals to the amount of the transportation of the recording paper 2. Thus, it is possible to calculate the diameter D of the paper roll 3 on the basis of the equation (4), which can be derived as a result of the mathematical changing of the equation (3).

In the configuration of the printer 1 according to the foregoing first embodiment of the invention, the recording paper 2 is transported by means of the paper transport roller 15. The amount of the transportation of the recording paper 2 is calculated on the basis of the amount of the rotation of the paper transport roller 15, that is, on the basis of the amount of the rotation of the paper transport motor 14. In such a configuration, the paper transport roller 15 is required to transport the recording paper 2 against the burden of the rotation of the paper roll motor 13, which is indirectly connected to the paper roll 3, which is heavy in weight, with the gear train 12 being interposed therebetween. As explained earlier, the speed reduction ratio of the gear train 12 is set at a large value. For this reason, slippage occurs more frequently between the paper transport roller 15 and the recording paper 2. In addition, a large tensile force is generated on the recording paper 2. Because of these reasons, there is a possibility that the printer 1 according to the foregoing first embodiment of the invention might fail to measure the transportation amount of the recording paper 2 accurately.

In contrast, in the configuration of the printer 1 according to the second embodiment of the invention described here, the transport detection roller 29 is provided as a roller that rotates freely as the recording paper 2 moves (i.e., is transported). Therefore, slippage is less likely to occur between the transport detection roller 29 and the recording paper 2, or at least, the degree thereof is substantially smaller even if it occurs. Because of the reduction in slippage therebetween, it is possible to improve precision in the measurement of the transportation amount of the recording paper 2. Consequently, it is possible to increase the measurement accuracy of the diameter of the paper roll 3.

As a modification example of the configuration explained above, the rotation amount of the slave roller 16 or the rotation amount of the slave roller 32 may be detected instead of detecting the rotation amount of the transport detection roller 29.

Printer Operation: Rotation Control of Paper Roll Motor

Next, an explanation is given below of the controlling of the rotation of the paper roll motor 13 on the basis of the diameter D of the paper roll 3, which has been measured as explained above, so as to set at least either one of the transportation speed of the recording paper 2 and the transportation distance thereof into a desired speed/distance value.

Transportation Speed Control

First of all, a method for controlling the rotation of the paper roll motor 13 on the basis of the preset relation between the measured diameter of the paper roll 3 and the rotation speed of the paper roll motor 13 is explained below. As illustrated in FIG. 10, the measured diameter D of the paper roll 3 and the rotation speed of the paper roll motor 13, the latter of which is denoted as F, are associated with each other, that is, set so as to correspond to each other, in a table T1. For example, the table T1 is memorized in the PROM 26 as pre-stored data. The rotation of the paper roll motor 13 is controlled with reference to, that is, while looking up, the table 1.

The left column of the table T1 shows the measured diameter D of the paper roll 3 divided in a plurality of diameter-value steps each of which specifies a predetermined range. The right column of the table T1 shows the rotation speed F of the paper roll motor 13. In the transportation speed control according to the present embodiment of the invention, the frequency of an encoder signal that is outputted from the rotary encoder 17, that is, the number of pulses that are outputted during a certain time period (e.g., one second) therefrom, is used as the rotation speed F of the paper roll motor 13. The rotation speed F of the paper roll motor 13 shown in the right column of the table T1 is set in such a manner that, when the paper roll 3 that has the diameter D that falls within a certain diameter range, that is, one of the fifteen steps shown in the left column thereof, is rotated with the corresponding speed that is set in the right column thereof, that is, the corresponding one among F1-F15, the rotation speed of the paper roll 3 on the circumferential surface thereof, that is, the transportation speed of the recording paper 2, is set to be a value within a predetermined range (predetermined value).

That is, the rotation speed F (F1-F15) of the paper roll motor 13 has been set in advance so as to ensure that the transportation speed of the recording paper 2 corresponding to the paper roll 3 having the measured diameter D (hereafter referred to as "the transportation speed of the recording paper 2 achieved by the paper roll 3") takes a predetermined value. Accordingly, it is possible to set the transportation speed of the recording paper 2 achieved by the paper roll 3 at a predetermined value by measuring the diameter D of the paper roll 3 and then rotating the paper roll motor 13 with the rotation speed F that corresponds to the measured diameter D of the paper roll 3.

The predetermined value of the transportation speed of the recording paper 2 achieved by the paper roll 3 is set at a speed value with which the operation of the printer 1 related to the rotation of the paper roll 3 is performed in proper working order. The CPU 25 determines which one of the fifteen ranges in the left column of the table T1 the measured diameter D of the paper roll 3 falls within and then controls the rotation of the paper roll motor 13 so that the paper roll motor 13 rotates at the rotation speed F that corresponds to the diameter range.

Specifically, for example, the table T1 can be configured so as to cause the printer 1 to perform the following operation.

Before the recording operation of the printer 1 is started, front-edge alignment is performed so as to ensure that recording is started at a predetermined position as viewed from the front edge (i.e., lower edge) of the recording paper 2. In the front-edge alignment, the position of the front edge of the recording paper 2 is adjusted with respect to the position of the recording head 19 as preparation for recording operation. For example, an optical sensor is used as a device that detects whether the front edge of the recording paper 2 is set at a predetermined target position or not. The positional detection is performed as follows. First, a user sets the recording paper 2 on the printer 1 at such a set position that the front edge of the recording paper 2 is well under the predetermined target position. Then, with the lower edge of the recording paper 2 set well under the predetermined target position, the paper roll 3 is rotated in the reverse direction so as to transport the recording paper 2 in an upward direction. That is, the recording paper 2 is taken up in the re-rolling direction. Then, the re-rolling rotation of the paper roll 3 is stopped at a position where the optical sensor detects the front edge of the recording paper 2. By this means, the front edge of the recording paper 2 is set at the predetermined target position.

In order for the optical sensor to detect the front edge of the recording paper 2 with high precision, it is necessary to transport the recording paper 2 upward at an appropriate speed. That is, it is necessary to set the rotation speed F of the paper roll motor 13 in such a manner that the transportation speed of the recording paper 2 is set at a predetermined transportation speed that makes it possible to detect the front edge of the recording paper 2 with high positional accuracy irrespective of the diameter D of the paper roll 3.

In view of the necessity explained above, for example, the diameter D of the paper roll 3 and the rotation speed F of the paper roll motor 13 are preset in the table T1 so as to ensure that, when the measured diameter D of the paper roll 3 falls within one of the fifteen ranges in the table T1, the recording paper 2 is transported (i.e., taken up so as to be rolled back to the paper roll 3) at such a desirable speed that makes it possible to detect the position of the front edge of the recording paper 2 with high positional precision since the paper roll motor 13 is rotated at one of the rotation speeds F1-F15 that corresponds to the diameter range within which the measured diameter D of the paper roll 3 falls. Accordingly, it is possible to rotate the paper roll motor 13 in such a manner that the transportation speed of the recording paper 2 is set at/in a predetermined value/range that makes it possible to detect the front edge of the recording paper 2 with high positional accuracy regardless of the diameter D of the paper roll 3.

In addition, as explained earlier, it is possible to ensure that the recording paper 2 is adequately tensioned and thus that no slack is formed therein between the paper transport mechanism 5 and the paper roll 3 during recording operation by controlling the rotation of the paper roll motor 13 in such a manner that the speed of the rotation of the paper roll 3 is slightly lower than the speed of the transportation of the recording paper 2 that is performed by the paper transport mechanism 5.

In view of the foregoing, the diameter D of the paper roll 3 and the rotation speed F of the paper roll motor 13 are preset in the table T1 so as to ensure that, when the measured diameter D of the paper roll 3 falls within one of the fifteen ranges in the table T1, the speed of the rotation of the paper roll 3 is slightly lower than the speed of the transportation of the recording paper 2 that is performed by the paper transport mechanism 5 since the paper roll motor 13 is rotated at one of the rotation speeds F1-F15 that corresponds to the diameter range within which the measured diameter D of the paper roll 3 falls. With the diameter D of the paper roll 3 and the rotation speed F of the paper roll motor 13 being preset in the table T1 so as to have the correspondences explained above, it is possible to make sure that the speed of the rotation of the paper roll 3 is slightly lower than the speed of the transportation of the recording paper 2 that is performed by the paper transport mechanism 5 by controlling the rotation of the paper roll motor 13 on the basis of the memory content of the table T1 at the time of recording operation. Accordingly, it is possible to transport the recording paper 2 in a forward direction while ensuring that the recording paper 2 is adequately tensioned and thus that no slack is formed therein between the paper transport mechanism 5 and the paper roll 3.

Transport speed control can be made on the basis of a table T2 illustrated in FIG. 11, too.

The center column of the table T2 shows a predetermined transportation speed V (V1, V2, . . . , Vn) of the recording paper 2 achieved by the paper roll 3 that has a predetermined diameter Ds. The right column of the table T2 shows a predetermined rotation speed C (C1, C2, . . . , Cn) of the paper roll motor 13 that is required for setting the transportation speed V of the recording paper 2 achieved by the paper roll 3 that has the predetermined diameter Ds into the value V that is shown at the left thereof, that is, V1, V2, . . . , Vn. Herein, the frequency of an encoder signal that is outputted from the rotary encoder 17 is taken as the rotation speed C.

Figures 12, 13:
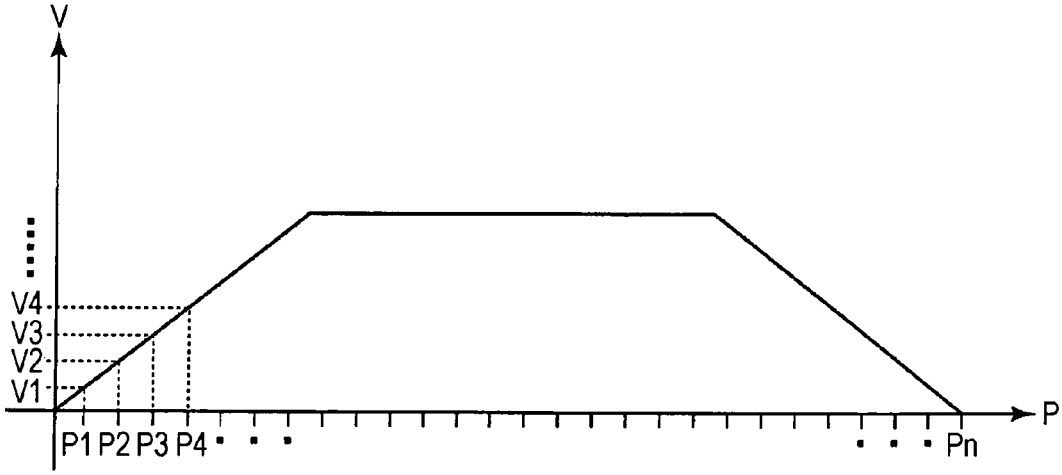
FIG. 12 is a graph that shows an example of a change in the predetermined transportation speed achieved by the paper roll that has the predetermined diameter according to an exemplary embodiment of the invention.
FIG. 13 is a table that shows an example of the relation between the diameter of the paper roll and the rotation amount of the paper roll motor according to an exemplary embodiment of the invention.

For example, it is assumed that the paper roll 3 that has the predetermined diameter Ds is rotated in the reverse direction so as to take up (i.e., re-roll) the recording paper 2 for the purpose of detecting the front edge of the recording paper 2 with the use of an optical sensor. Herein, it is further assumed that the paper roll 3 is rotated in such a manner that the transportation speed of the recording paper 2 achieved by the paper roll 3 changes with the transportation speed V1, V2, . . . , Vn corresponding to the amount of the rotation of the paper roll 3 (the transportation distance of the recording paper 2) P (P1, P2, . . . , Pn) since the start of the rotation of the paper roll 3 as illustrated in FIG. 12. Therefore, as a result of the detection of the rotation amount P of the paper roll motor 13 corresponding to the rotation amount P of the paper roll 3 since the start of the rotation thereof with the use of the rotary encoder 17 and the rotation of the paper roll motor 13 at the rotation speed C1, C2, . . . , Cn at the timing corresponding to the rotation amount P, the recording paper 2 is taken up and thus rolled back to the paper roll 3 at the transportation speed V1, V2, . . . , Vn illustrated in FIG. 12.

Then, on the basis of the table T2, the CPU 25 computes the rotation speed of the paper roll motor 13 that is required for setting the transportation speed of the recording paper 2 achieved by the paper roll 3 that has the diameter D into the speed value V1, V2, . . . , Vn. The computation is performed by, as a first step, calculating a multiplying factor L, which is the ratio of the predetermined diameter Ds to the measured diameter D of the paper roll 3, that is, the predetermined diameter Ds divided by the measured diameter D of the paper roll 3 (=Ds/D). Then, the paper roll motor 13 is rotated at a rotation speed that is equal to the rotation speed C1, C2, . . . , Cn multiplied by the multiplying factor L. By this means, it is possible to rotate the paper roll 3 that has the diameter D by the speed V1, V2, . . . , Vn.

For example, it is assumed that the predetermined diameter Ds of the paper roll 3 is 100 mm. It is further assumed herein that the rotation speed C1 of the paper roll motor 13 under the condition that the transportation speed V1 of the recording paper 2 at the time of the re-rolling operation thereof is one inch per second (1 inch/sec.) is 100 EP per second (100 EP/sec.), where the EP represents the number of encoder pulses. The measured diameter D of the paper roll 3 is assumed to be 50 mm. Under these assumptions, since Ds/D=100 mm/50 mm=2, it is possible to take up the recording paper 2 for the re-rolling thereof at the transportation speed V1 (1 inch/sec.) by rotating the paper roll motor 13 at the rotation speed of 200 EP/sec (2×100 EP/sec.=200 EP/sec.).

As another example, the rotation speed C1 of the paper roll motor 13 under the condition that the transportation speed V2 of the recording paper 2 at the time of the re-rolling operation thereof is 1.5 inch per second (1.5 inch/sec.) is assumed to be 150 EP per second (150 EP/sec.).

In this example, it is possible to take up the recording paper 2 for the re-rolling thereof at the transportation speed V2 (1.5 inch/sec.) by rotating the paper roll motor 13 at the rotation speed of 300 EP/sec (2×150 EP/sec.=300 EP/sec.). As explained above, it is possible to set the transportation speed of the recording paper 2 achieved by the paper roll 3 that has the diameter D at the speed V1, V2, . . . , Vn by performing rotation control so as to set the rotation speed of the paper roll motor 13 at a speed value that is equal to the rotation speed C1, C2, . . . , Cn multiplied by the multiplying factor L. The table T2 is prepared by finding, through experimentation, calculation, or the like, the rotation speed of the paper roll motor 13 at the time when the recording paper 2 is transported with the use of the paper roll 3 that has the predetermined diameter Ds at the predetermined transportation speed. The table T2 is memorized in, for example, the PROM 26 as pre-stored data.

Transportation Distance Control

The CPU 25 can calculate the amount of the rotation of the paper roll motor 13 that is required for transporting the recording paper 2 by a desired transportation distance with the use of the following formula (5).

$$R=(H\times P\times G)/(D\times \Pi) \quad (5)$$

H: the target distance by which the transportation of the recording paper 2 is desired (i.e., desired transportation distance)

R: the rotation amount of the paper roll motor 13 (the number of pulses of an encoder signal) that is required for transporting the recording paper 2 by the desired transportation distance H P: the number of pulses of an encoder signal outputted at the time of 360-degree rotation of the output shaft of the paper roll motor 13

G: the speed reduction ratio of the gear train 12, which provides connection between the paper roll motor 13 and the left roll support shaft 11L D: the measured diameter D of the paper roll 3

Π: the ratio of the circumference to its diameter

When it is desired to take up the recording paper 2 for the re-rolling thereof by the transportation distance H, the paper roll motor 13 is rotated by the rotation amount that corresponds to the number of pulses R of an encoder signal with the use of the formula (5) shown above. By this means, it is possible to roll the recording paper 2 back to the paper roll 3 by the desired transportation distance H.

As explained above, it is possible to transport the recording paper 2 by a desired transportation distance regardless of the diameter of the paper roll 3, which offers, for example, the following advantageous effects.

In a case where the recording paper 2 is transported obliquely, or, in other words, in a case where so-called skew has occurred, it is possible to troubleshoot the oblique transportation by rotating the paper roll motor 13 in the reverse direction so as to take up the recording paper 2 for the re-rolling thereof onto the paper roll 3. In such a case, the re-rolling amount of the recording paper 2 is determined on the basis of the rotation amount of the paper roll motor 13 that is detected by the rotary encoder 17. However, the actual amount of the re-rolling of the recording paper 2 corresponding to the amount of the rotation of the paper roll motor 13 differs from one to another depending upon the diameter of the paper roll 3. That is, even for the same amount of the rotation of the paper roll motor 13, the take-up amount (i.e., roll-back amount, re-rolling amount) of the recording paper 2 when the diameter of the paper roll 3 is relatively large is larger in comparison with the take-up amount of the recording paper 2 when the diameter of the paper roll 3 is relatively small. On the other hand, it is necessary to roll the recording paper 2 back to the paper roll 3 by at least a certain minimum length in order to troubleshoot oblique transportation. However, it is not possible to accurately determine the take-up amount of the recording paper 2 merely on the basis of the rotation amount of the paper roll motor 13.

For this reason, if the take-up amount of the recording paper 2 is determined on the basis of the amount of the rotation of the paper roll motor 13 only, it is impossible to troubleshoot the skew problem because of the insufficient re-rolling amount of the recording paper 2 in a case where the diameter of the paper roll 3 is small. On the other hand, the re-rolling amount of the recording paper 2 is large in a case where the diameter of the paper roll 3 is large, which might result in the recording paper 2 coming off from the paper transport roller 15 in an upward direction. In view of the foregoing, in the transportation distance control according to the present embodiment of the invention, the rotation amount of the paper roll motor 13 is set on the basis of the above formula (5) so as to ensure predetermined take-up amount (transportation distance). Therefore, it is possible to adequately set the take-up amount of the recording paper 2 by the paper roll.

In addition, as illustrated in FIG. 13, the measured diameter D of the paper roll 3 and the rotation amount L (L1, L2, . . . , L15) of the paper roll motor 13 may be pre-stored in association with, that is, in correspondence to, each other as a table T3 in the PROM 26. Then, the rotation amount of the paper roll motor 13 can be set on the basis of the table T3 so that the recording paper 2 is taken up by the predetermined take-up amount (transportation distance).

The diameter D of the paper roll 3 and the rotation amount L (L1-L15) of the paper roll motor 13 are preset in the table T3 so as to ensure that, when the measured diameter D of the paper roll 3 falls within one of fifteen ranges in the table T3, the take-up amount of the recording paper 2 by the paper roll 3 is properly set since the paper roll motor 13 is rotated by one of the rotation amounts L1-L15 that corresponds to the diameter range within which the measured diameter D of the paper roll 3 falls. Accordingly, it is possible to control and set the transportation distance of the recording paper 2 at a predetermined value regardless of the diameter D of the paper roll 3.

In the configuration of the printer 1 according to the foregoing exemplary embodiments of the invention, it is explained that a recording apparatus is embodied as an ink-jet printer that ejects ink. However, the scope of the invention is not limited to such an exemplary configuration. For example, the invention is applicable to a variety of fluid-ejection recording apparatuses that eject or discharge various kinds of fluid or liquid that includes ink but not limited thereto from a variety of fluid ejecting heads (i.e., a variety of recording heads). For example, the invention is applicable to a fluid-ejection recording apparatus that ejects a liquid/liquefied matter/material that is made as a result of dispersion of particles of functional material(s) into/with the liquid or fluid. The invention is further applicable to a fluid-ejection recording apparatus that ejects a gel substance. The invention is further applicable to a fluid-ejection recording apparatus that ejects other type of non-liquid fluid such as a (semi-) solid substance that can be ejected as a fluid. It should be noted that the scope of the invention is not limited to those enumerated above. A recording apparatus to which the concept of the invention can be applied is not limited to a fluid ejecting apparatus that ejects ink or other fluids. For example, the recording apparatus according to an aspect of the invention may be embodied as a thermal printer that performs recording on a sheet of thermal recording paper (i.e., thermo-sensitive paper). Or, the recording apparatus according to an aspect of the invention may be embodied as an impact printer that uses an ink ribbon or the like. A recording target medium to which the concept of the invention can be applied is not limited to the recording paper 2. For example, the recording target medium according to an aspect of the invention may be embodied as cloth, sheet-type resin, or the like.

What is claimed is:

1. A recording apparatus that performs recording on a recording target medium that is fed from a roll object that is set in or on the recording apparatus, the roll object being formed as at least a roll of the recording target medium, the recording apparatus comprising:

a rotating section that rotates the roll object;

a rotation controlling section that controls rotation of the rotating section; and a roll object diameter measuring section that measures a diameter of the roll object, wherein the rotation controlling section sets at least one of a rotation speed of the rotating section and a rotation amount of the rotating section on the basis of the diameter of the roll object measured by the roll object diameter measuring section so as to ensure that at least one of a transportation speed of the recording target medium and a transportation distance of the recording target medium away from the roll object is set at a predetermined value, wherein said transportation distance is an amount of travel of said recording target medium after a start of rotation of said roll object.

2. The recording apparatus according to claim 1, wherein a table in which the diameter of the roll object and at least one of the rotation speed of the rotating section and the rotation amount of the rotating section are set in association with each other so as to ensure that at least one of the transportation speed of the recording target medium and the transportation distance of the recording target medium is set at the predetermined value is pre-stored; and the rotation controlling section sets the at least one of the rotation speed of the rotating section and the rotation amount of the rotating section based on the table.

3. The recording apparatus according to claim 1, further comprising a multiplying factor computing section that calculates a multiplying factor as a ratio of a predetermined diameter of the roll object to a measurement diameter of the roll object that has been measured by the roll object diameter measuring section, wherein a table in which a rotation speed of the rotating section that is required for setting the transportation speed of the recording target medium corresponding to the roll object that has the predetermined diameter to a predetermined value is set is pre-stored; and the rotation controlling section sets the rotation speed of the rotating section at a value that is equal to the rotation speed set in the table multiplied by the multiplying factor calculated by the multiplying factor computing section.

4. The recording apparatus according to claim 1, wherein the roll object diameter measuring section includes a roll object rotation amount detecting section that detects an amount of the rotation of the roll object, a transportation amount detecting section that detects the amount of the transportation of the recording target medium, and a computing section that computes the diameter of the roll object on the basis of the rotation amount of the roll object detected by the roll object rotation amount detecting section and the transportation amount of the recording target medium detected by the transportation amount detecting section.

5. The recording apparatus according to claim 1, further including a transport detection roller that rotates freely as the recording paper moves and a rotary encoder mounted thereon.

6. The recording apparatus according to claim 5, wherein a duty ratio of a voltage that is applied to the transport detection roller is used to detect whether there is lack of tension in the recording target medium between the roll object and the transport detection roller.

7. The recording apparatus according to claim 6, wherein the diameter of the roll object is calculated based on a rotation amount of the transport detection roller and a rotation amount of the rotating section.

8. A method for controlling the rotation of a rotating section in a recording apparatus that performs recording on a recording target medium that is fed from a roll object that is rotated by a rotating section, the roll object being formed as at least including a roll of the recording target medium, the rotation controlling method comprising: measuring a diameter of the roll object; and setting a rotation speed of the rotating section and a rotation amount of the rotating section on the basis of the measured diameter of the roll object so as to ensure that at least one of a transportation speed of the recording target medium and a transportation distance of the recording target medium away from the roll object is set at a predetermined value, wherein said transportation distance is an amount of travel of said recording target medium after a start of rotation of said roll object.

* * * * *